United States Patent [19]

Zunkel

[11] Patent Number: 4,627,491

[45] Date of Patent: Dec. 9, 1986

[54] WELL PACKER

[75] Inventor: Gary D. Zunkel, Chickasha, Okla.

[73] Assignee: Halliburton Company, Duncan, Okla.

[21] Appl. No.: 757,109

[22] Filed: Jul. 19, 1985

[51] Int. Cl.[4] ..... E21B 33/28

[52] U.S. Cl. ..... 166/126; 166/133; 166/134; 166/142

[58] Field of Search ..... 166/126, 128, 131, 133, 166/134, 138, 139, 140, 146, 150, 51, 278, 142

[56] References Cited

U.S. PATENT DOCUMENTS

| | | | |
|---|---|---|---|
| 2,806,536 | 9/1957 | Baker et al. | 166/138 |
| 3,387,658 | 6/1968 | Lebourg | 166/134 |
| 3,399,729 | 9/1968 | McGill | 166/134 |
| 3,434,538 | 3/1969 | Kilgore et al. | 166/131 |
| 3,570,596 | 3/1971 | Young | 166/134 |
| 3,584,684 | 6/1971 | Anderson et al. | 166/129 |
| 4,427,063 | 1/1984 | Skinner | 166/134 |
| 4,440,218 | 4/1984 | Farley | 166/51 |
| 4,474,239 | 10/1984 | Colomb et al. | 166/278 |

OTHER PUBLICATIONS

Abstract from Application Serial No. 756,885 by Gary D. Zunkel and Michael L. Bolin, filed 7/19/85.

Abstract from Application Serial No. 756,886 by Gary D. Zunkel filed 7/19/85.

Abstract from Application Serial No. 756,892 by Michael L. Bolin filed 7/19/85.

Abstract from Application Serial No. 757,036 by Gary D. Zunkel filed 7/19/85.

Abstract from Application Serial No. 757,040 by Gary D. Zunkel and Michael L. Bolin, filed 7/19/85.

Abstract from Application Serial No. 757,109 by Gary D. Zunkel filed 7/19/85.

Abstract from Application Serial No. 757,115 by Gary D. Zunkel filed 7/19/85.

*Primary Examiner*—James A. Leppink
*Assistant Examiner*—Terry Lee Melius
*Attorney, Agent, or Firm*—Joseph A. Walkowski

[57] ABSTRACT

The present invention comprises a mechanically set pack-off device adapted to be run into a wellbore on a tubing or pipe string, the pack-off device including upper and lower slip means, packing element means therebetween, drag block means, J-slot means to releasably maintain the pack-off device in an unset mode, ratchet means to releasably lock the device in a set mode, biasing means to maintain the set of the slip means and compression of the packing element means in the device's set mode, and closeable bypass means around said packing element means.

8 Claims, 9 Drawing Figures

WELL PACKER

BACKGROUND OF THE INVENTION

The present invention relates to packers and bridge plugs, commonly referred to as pack-off devices, such as are employed to seal across wellbores in oil and gas wells, and particularly to mechanically set pack-off devices.

SUMMARY OF THE INVENTION

The present invention comprises a mechanically set pack-off device adapted to be run into a wellbore on a tubing or pipe string, the pack-off device including upper and lower slip means, packing element means therebetween, drag block means, J-slot means to releasably maintain the pack-off device in an unset mode, ratchet means to releasably lock the device in a set mode, biasing means to maintain the set of the slip means and compression of the packing element means in the device's set mode, and closeable bypass means around said packing element means. The device may be employed with a plug in the bore thereof as a bridge plug, or as a packer in combination with any of a variety of valves such as are well known in the well tool art.

BRIEF DESCRIPTION OF THE DRAWINGS

The present invention will be more readily understood by one of ordinary skill in the art through a review of the following detailed description of the preferred embodiment, taken in conjunction with the accompanying drawings, wherein.

DETAILED DESCRIPTION OF THE PREFERRED EMBODIMENT

Figure 1A:
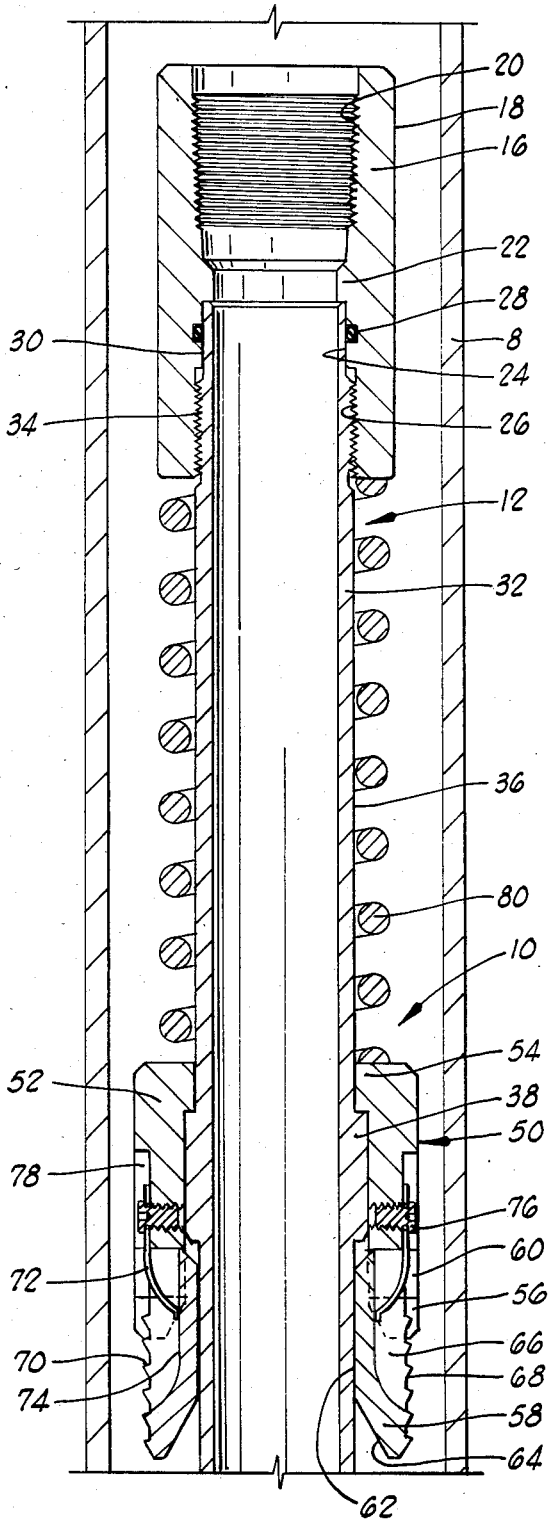
FIGS. 1A–1D comprise a full sectional elevation of the pack-off device of the present invention unset in a cased wellbore.
Figure 1B:
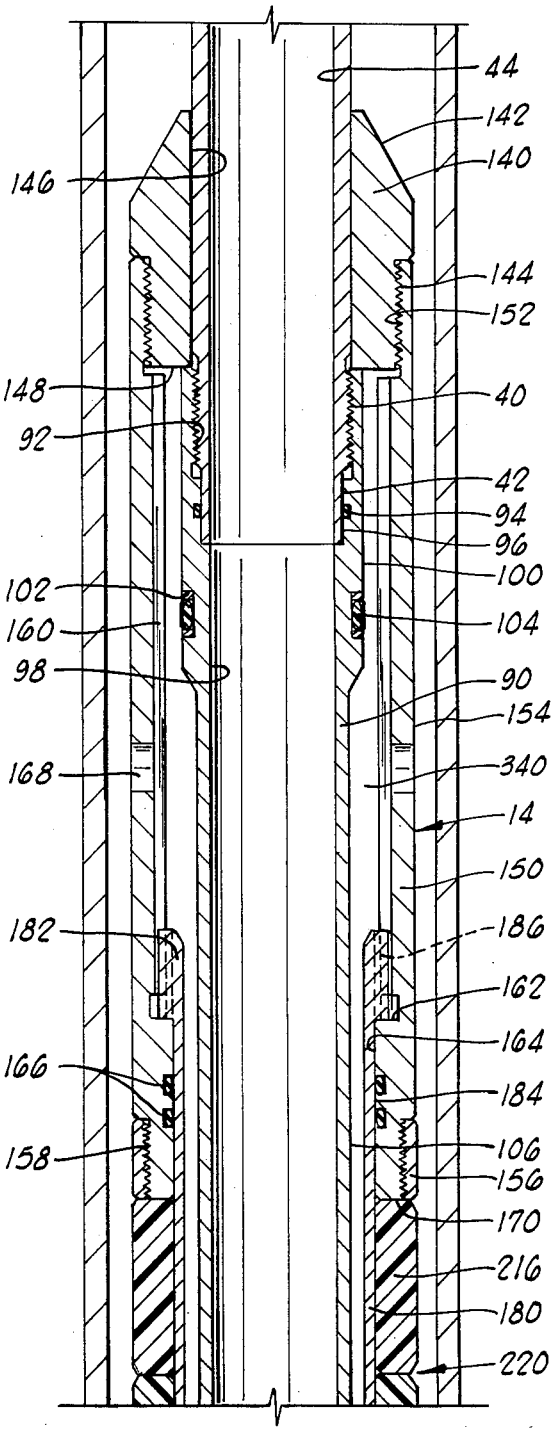
Figure 1C:
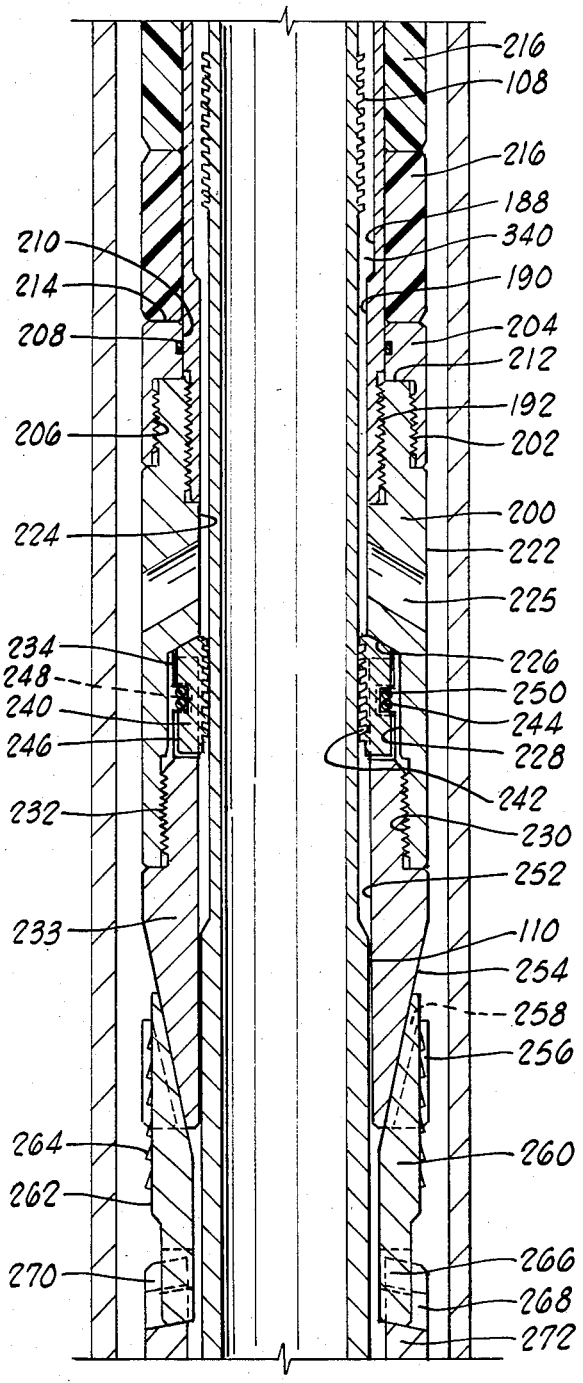
Figure 1D:
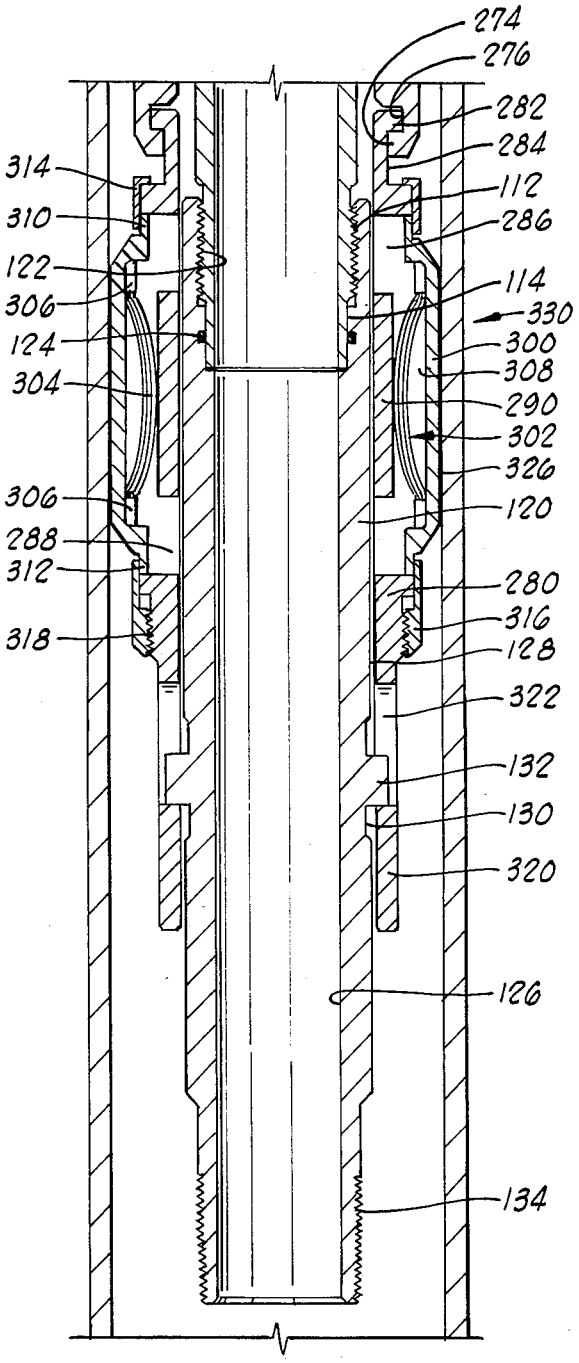

Referring to FIGS. 1A–1D and 3, pack-off device 10 disposed in wellbore casing 8 comprises mandrel assembly 12 surrounded by housing assembly 14.

Mandrel assembly 12 includes upper adapter 16 having a cylindrical exterior 18, and threaded entry bore 20 for securing pack-off device 10 to a tubing string (not shown). Entry bore 20 terminates at shoulder 22, below which seal bore 24 extends to threaded exit bore 26. O-ring 28 provides a seal between seal surface 30 on upper mandrel 32 where threaded surface 34 thereon is made up in exit bore 26 of upper adapter 16. Below threaded surface 34, upper mandrel 32 includes cylindrical exterior surface 36, which includes annular shoulder 38 thereon. At the lower end of surface 36, threaded surface 40 leads to seal surface 42 at the bottom of upper mandrel 32. The bore wall 44 of upper mandrel 32 is of substantially the same diameter as that of shoulder 22 of upper adapter 16.

Upper slip assembly 50 is disposed on upper mandrel 32 about shoulder 38. Upper slip collar 52, having annular shoulder 54 on the interior thereof, rides over shoulder 38. Longitudinally extending, circumferentially disposed slots 56 extending to the bottom of slip collar 52 accommodate slips 58 therein, laterally extending legs (not shown) at the upper ends of slips 58 residing in lateral channels 60 of slots 56. Slips 58 have arcuate inner surfaces 62, leading to oblique bottom surfaces 64, while the exterior of slips 58 includes a longitudinal slot 66 bounded by slip walls 68 having teeth 70 thereon. Leaf springs 72 contacting the bottoms 74 of slots 66, and anchored by bolts 76 in spring slots 78 of slip collar 52, maintain slips 58 against exterior surface 36 of upper mandrel 32.

Coil spring 80, surrounding upper mandrel 32, bears against the bottom of upper adapter 16 and the top of slip collar 52 in a substantially relaxed state in FIG. 1A.

Bypass seal mandrel 90, having threaded entry bore 92 at the top interior thereof is sealed with seal surface 42 on upper mandrel 32 by O-ring 94 when made up therewith. The interior of bypass seal mandrel 90 below seal cavity 96, comprises bore wall 98 of substantially the same diameter as that of upper mandrel bore wall 44. At the upper exterior of bypass seal mandrel 90, seal saddle 100 including shallow annular groove 102 therein accommodates bypass seal 104. Below saddle 100, the exterior of bypass mandrel 90 necks down to cylindrical ratchet surface 106 having left-hand ratchet threads 108 extending outwardly therefrom. At the bottom of bypass seal mandrel 90, enlarged exterior cylindrical surface 110 leads to threaded surface 112 and seal surface 114.

J-slot mandrel 120 is secured to threaded surface 112 via threaded entry bore 122, O-ring 124 therebelow providing a seal with bypass seal mandrel 90 against seal surface 114 thereof. The interior of J-slot mandrel 120 comprises bore wall 126, of substantially the same diameter as bore wall 98. The exterior of slot mandrel 120 includes cylindrical surface 128 having recessed area 130 cut therein, from which J-slot lugs 132 radially protrude. The bottom of J-slot mandrel 120 terminates with exterior threads 134, by which a plug or valve (not shown) as known in the art may be secured to pack-off device 10.

Upper adapter 16, upper mandrel 32, bypass mandrel 90, J-slot mandrel 120, upper slip assembly 50 and coil spring 80 comprise mandrel assembly 12.

Housing assembly 14 includes upper slip wedge collar 140, having frusto-conical slip ramp 142 at the top thereof, threaded cylindrical surface 144 therebelow on the exterior, and an axial bore defined by bore wall 146 extending therethrough, through which upper mandrel 32 is slidably disposed, lower lip 148 on slip wedge collar 140 abutting the top of bypass mandrel 90.

Upper bypass case 150 is secured to collar 140 by threaded entry bore 152 mating with threaded surface 144. Exterior cylindrical surface 154 extends downward to packer compression ring 156, which surrounds the lower end of upper bypass case 150 and is joined thereto at threaded junction 158. The interior of upper bypass case 150 includes longitudinally extending splines 160, which extend to radial shoulder 162, below which the interior necks down to seal bore 164, having O-rings 166 disposed in recesses therein. Bypass ports 168 extend through the wall of case 150, and the lower ends of case 150 and co-extensive packer compression ring 156 provide radially flat upper packer compression shoulder 170.

Tubular packer saddle 180 extends through seal bore 164 of case 150, the upper annular end 182 of saddle 180 being of larger diameter than cylindrical packer element surface 184 and containing longitudinal slots 186 therein which slidably mate with splines 160 on the interior of case 150. The upper interior of saddle 180 is undercut to provide an enlarged ratchet bore 188 to clear ratchet teeth 108, and a seal surface against which seal 104 may act when pack-off device 10 is set. The lower interior of saddle 180 necks down to exit bore 190.

Saddle 180 is secured at threaded junction 192 to lower bypass case 200, case 200 having threads 202 on its upper exterior by which lower packer compression ring 204 is secured via threads 206. An O-ring 208 carried in seal bore 210 of ring 204 seals against packer element surface 184 of saddle 180. Lower packer compression ring 204 extending over the upper face 212 of lower bypass case 200 provides a radially flat lower packer compression shoulder 214. Three annular elastomeric packer elements 216 comprise packer element means 220 and are disposed about packer saddle 180.

The exterior 222 of lower bypass case 200 is substantially cylindrical while the middle bore 224 thereof below threaded junction 192 is cylindrical and of substantially the same diameter as exit bore 190 of saddle 180, lower bypass ports 225 extending through the wall of case 200 into middle bore 224. Below middle bore 224, chamfered surface 226 leads obliquely outward to ratchet dog bore wall 228, below which threaded exit bore 230 is secured to threaded surface 232 on the upper exterior of lower slip wedge collar 233. Ratchet dog annulus 234, defined between lower bypass case 200, lower slip wedge collar 233 and bypass seal mandrel 90, contains a plurality of arcuate ratchet dogs 240 having left-hand threads 242 cut on the interior thereof, and circumferentially extending slots 244 on the exterior thereof. Spacer legs 246 extending upwardly from lower slip wedge collar 233 separate ratchet dogs 240, legs 246 also containing slot 248 therein aligned with slots 244 on dogs 240. Garter springs or elastic bands 250 extend through slots 244 and 248 about ratchet dogs 240 and spacer legs 246.

The bore 252 of collar 233 is substantially the same as that of middle bore 224 of lower bypass case 200. The lower exterior of collar 233 comprises slip ramps 254 separated by spacer walls 256 having undercut therein lateral channels 258 adjacent the surface ramps 254. Lower slips 260 ride on ramps 254, lateral webs (not shown) extending into channels 258 in walls 256. The upper exterior of slips 260 comprises slip face 262 having teeth 264 thereon. The lower exterior of slips 260 comprises T-shaped strut 266, the laterally oriented ends of which extend into grooves 268 in the sides of strut channels 270 at the upper end of lower slip collar 272, which is comprised of a plurality of arcuate sections secured together by means well known in the art to form a collar.

Drag block assembly 330 includes drag block housing 280 which interlocks via outwardly facing annular shoulder 282 and recess 284 with inwardly facing shoulder 274 and recess 276 on lower slip collar 272 as the arcuate segments forming slip collar 272 are secured together. Drag block housing 280 contains a plurality of drag block cavities 286 therein, separated by walls 288, arcuate spring bases 290 extending therebetween about J-slot mandrel 120. Drag blocks 300 are disposed in cavities 286 over leaf springs 302, the centers 304 of which bear against spring bases 290, and the ends 306 of which bear against drag blocks 300 in spring cavities 308. Lips 310 and 312 at each end of drag blocks 300 extend longitudinally therefrom, retainer ring 314 maintaining top lips 310 inside cavities 286, and retainer collar 316, which is secured at threaded junction 318 to drag block housing 280, maintains lower lips 312 in cavities 286. The exteriors 326 of drag blocks 300 bear against the walls of casing 8, and may have carbide inserts (not shown) embedded therein to reduce wear.

Figure 3:
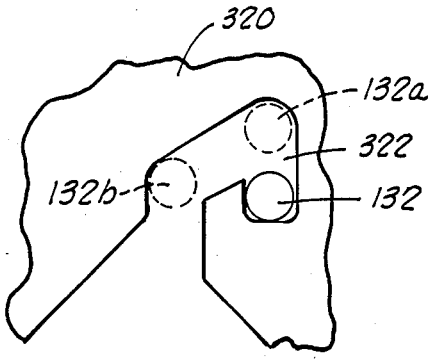
FIG. 3 comprises a development of the J-slot and lug employed in the J-slot means of the pack-off device of the present invention.

The lower end of drag block housing 280 comprises J-slot case 320, including J-slots 322 therein, which receive J-slot lugs 132 (see FIG. 3).

Upper slip wedge collar 140, upper bypass case 150, packer compression ring 156, packer saddle 180, lower bypass case 200, lower packer compression ring 204, packer element means 220, ratchet dogs 240, lower slip wedge collar 233, lower slips 260, lower slip collar 272 and drag block assembly 330 comprise housing assembly 14.

OPERATION OF THE PREFERRED EMBODIMENT

To set pack-off device 10 in a wellbore casing 8, the tool is run into the wellbore on the end of a tubing or pipe string, hereinafter referred to as the work string. The pack-off device 10 is in its unset state as depicted in FIGS. 1A–1D, and the J-slot lugs 132 are in the position illustrated in FIG. 3 in solid lines, bypass passage 340 being open.

It should be recognized that a bypass passage 340, to prevent swabbing as the unset packer moves through casing 8, is provided via upper bypass ports 168, an annular channel defined between upper bypass case 150, packer saddle 180, lower bypass case 200 of housing assembly 14 and bypass seal mandrel 90 of mandrel assembly 12, and lower bypass ports 225.

When pack-off device is at the desired location in casing 8, the work string is picked up, moving lugs 132 to position **132*a* (FIG. 3), and rotated to the right, placing lugs 132 in position 132*b*. The work string is then set down against the frictional drag provided by drag blocks 300, and lugs 132, now in the open-ended portion of J-slots 322, exit therefrom. As a result, mandrel assembly 12 may freely travel downward through housing assembly 14**.

Upper slips 58 contact upper slip wedge collar 140, the latter in conjunction with upper bypass case 150, packer element means 220, lower bypass case 200, lower slip wedge collar 233 moving downward to move lower slips 260 outward against casing 8. After lower slips 260 grip casing 8, packer element means 220 is compressed outwardly against casing 8 by upper and lower packer compression shoulders 170 and 214, upper bypass case 150 telescoping over packer saddle 180 to provide the compression stroke. As packer element means 220 is compressed, upper slips 58 are moved outward into engagement with casing 8 by upper slip wedge collar 140, coil spring 80 providing a constant biasing force to maintain slips 58 and 260 set, and packer element means 220 compressed.

During the setting process, mandrel means 12 with bypass mandrel 90 continues its downward movement through housing assembly 14. Ratchet teeth 108 on mandrel 90 contact and engage mating teeth 242 on ratchet dogs 240 as ratchet dogs 240 are biased outwardly against spring or band 250, locking mandrel assembly 12 in position with respect to housing assembly 14, and pack-off device 10 in the set mode depicted in FIGS. 2A–2D.

Figure 2A:
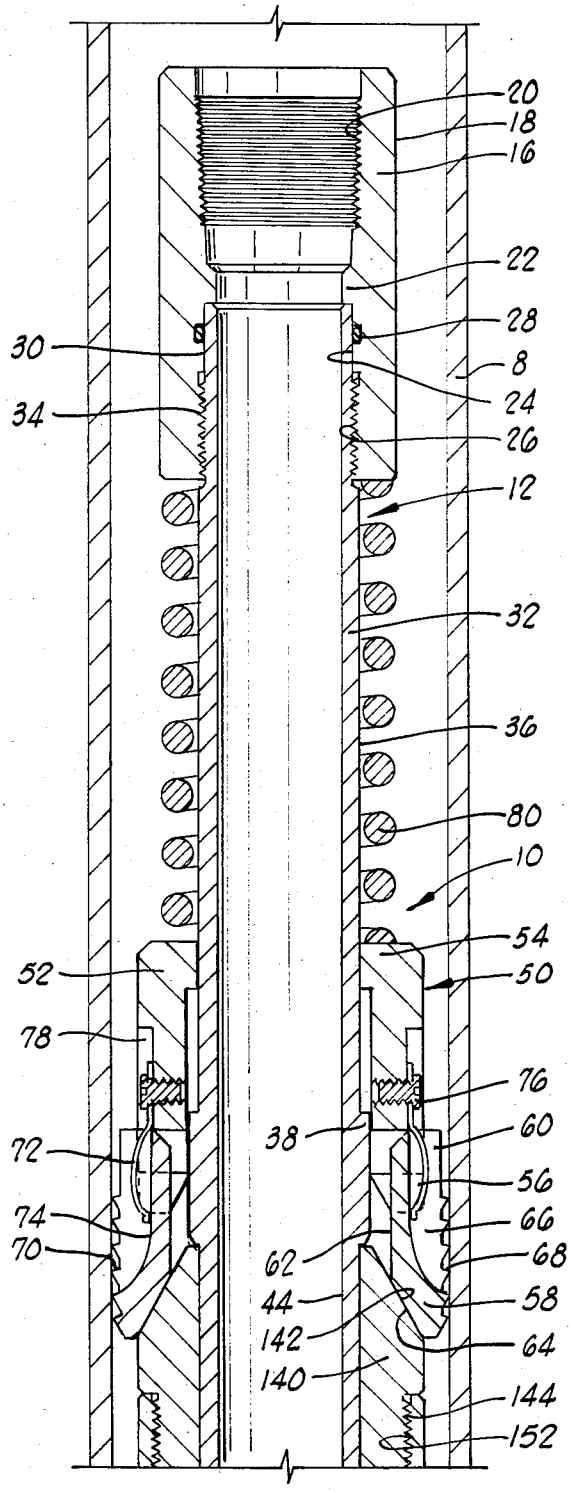
FIGS. 2A–2D comprise a full sectional elevation of the pack-off device of the present invention set in a cased wellbore.
Figure 2B:
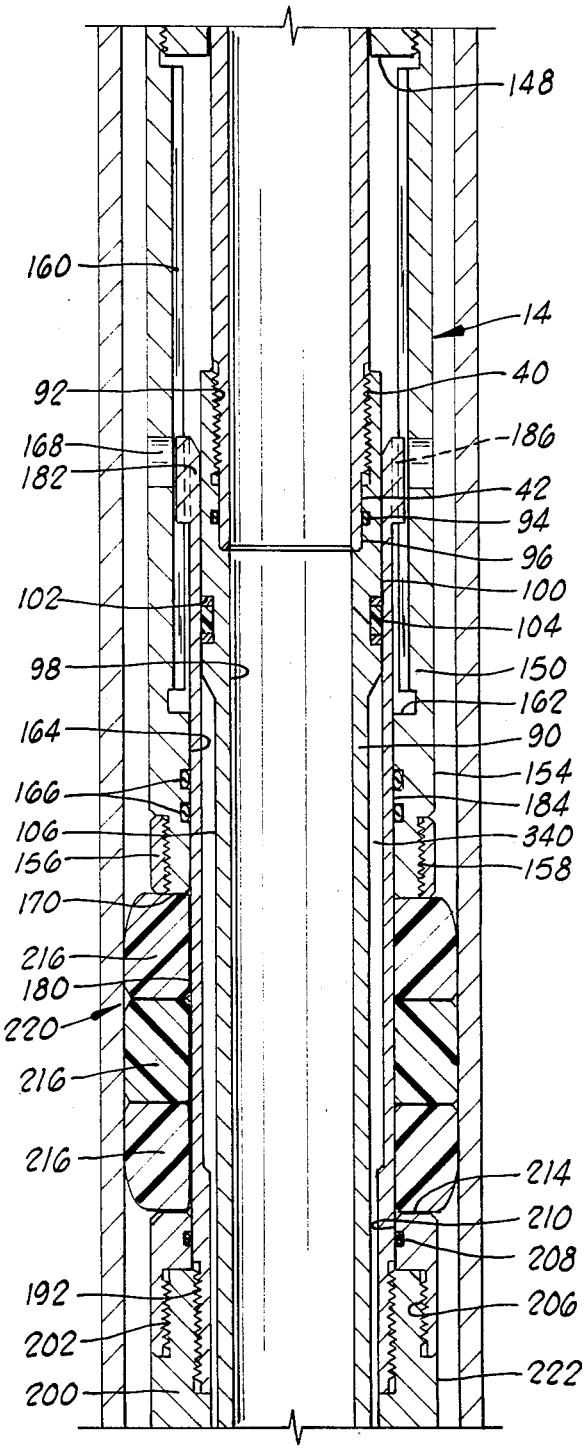
Figure 2C:
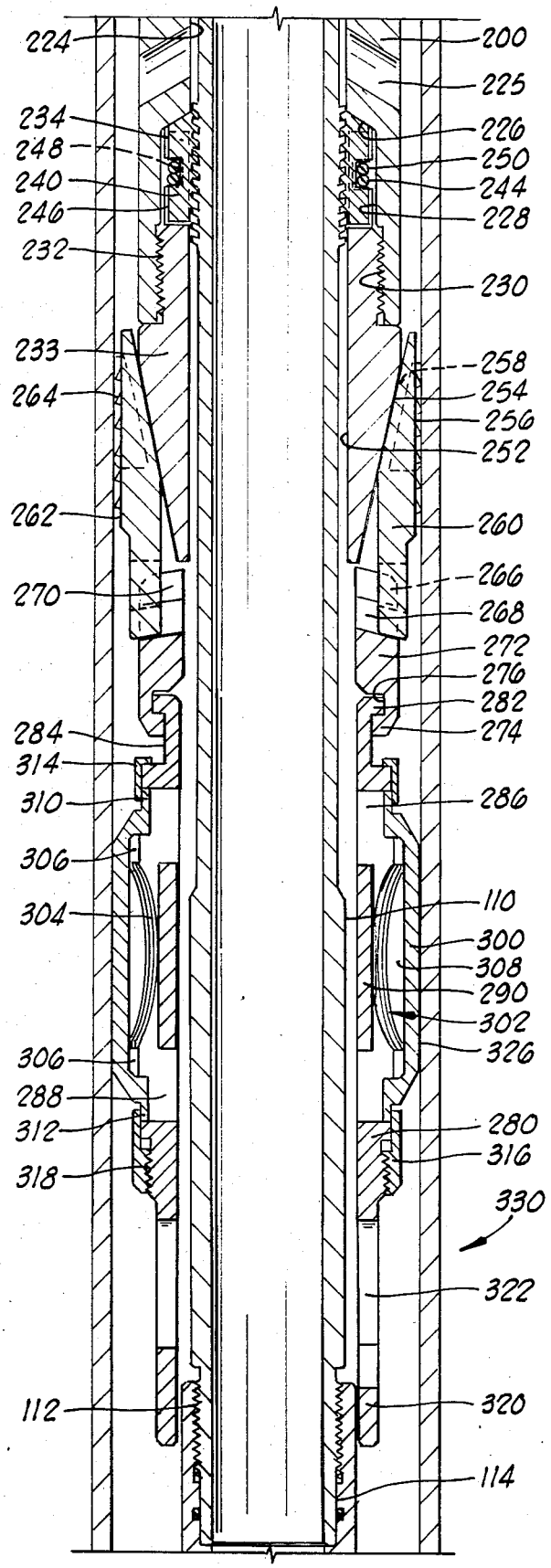
Figure 2D:
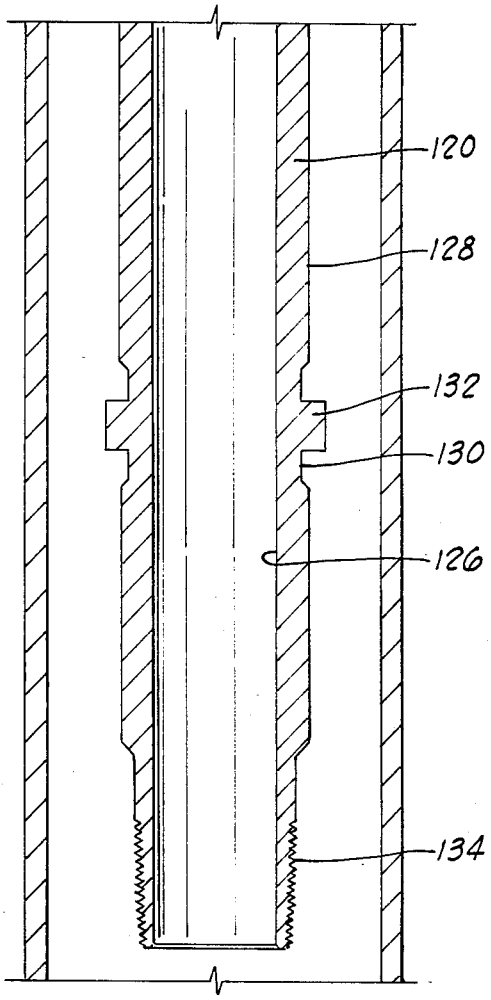

It will be readily noted in FIG. 2B that the ratchet bore 188 of saddle 180 has contacted bypass seal 104, closing the bypass passage 340 through pack-off device 10 around packer element means 220.

To unset pack-off device 10, the work string is rotated to the right to back-off the ratchet teeth 108 on ratchet mandrel 90 from teeth 242 on ratchet dogs 240, mandrel assembly 12 then being picked up to unset upper slips 58, decompress packer element means 220, and unset lower slips 260. Bypass passage 340 is opened during the first part of the upward travel of mandrel assembly 12.

If pack-off device 10 is to be removed from casing 8, the work string can merely be pulled from the wellbore. If it is to be set at a higher level in casing 8, setting down the work string will cause pack-off device 10 to reset in the manner described above. If it is to be reset at a lower level in casing 8, slight left-hand torque should be applied after backing-off the ratchet and pulling up, and the work string set down to return lugs 132 to their initial positions shown in solid lines in FIG. 3.

It will be apparent to one of ordinary skill in the art that a novel and unobvious pack-off device has been invented. Many additions, deletions and modifications to the preferred embodiment may, of course, be made without departing from the spirit and scope of the claimed invention.

I claim:

1. A pack-off device for use in a wellbore, comprising:

a tubular mandrel;

an upper slip assembly slidably disposed on said mandrel;

biasing means acting in a downward direction on said upper slip assembly;

bypass seal means disposed about the exterior of said mandrel on a raised annular shoulder below said upper slip assembly;

ratchet teeth on said mandrel below said bypass seal means;

at least one J-slot lug radially extending from said mandrel below said ratchet teeth; and a housing assembly disposed about said mandrel in slidable relationship thereto, said housing assembly including;

an upper slip wedge collar;

an upper bypass case secured to said upper slip wedge collar;

a packer saddle extending upwardly inside said upper bypass case in telescoping longitudinally slidable, non-rotatable relationship thereto;

packer element means disposed on said packer saddle;

a lower bypass case secured to said packer saddle;

a lower slip wedge collar secured to said lower bypass case and defining a ratchet dog annulus therewith and with said mandrel;

a plurality of inwardly-biased ratchet dogs disposed in said ratchet dog annulus and having teeth on their radially inward surfaces adapted to mate with said mandrel ratchet teeth;

a plurality of circumferentially disposed lower slips slidably secured to said lower slip wedge collar;

a drag block assembly secured to said plurality of slips, said drag block assembly including a plurality of outwardly biased drag blocks thereon and at least one J-slot therein adapted to cooperate with said at least one J-slot lug extending from said mandrel; and a closeable bypass passage between said housing assembly and said mandrel extending between upper bypass ports in said upper bypass case and lower bypass ports in said lower bypass case through an annular channel defined between said mandrel below said bypass seal means and the interior of said packer saddle, said bypass passage being closeable through longitudinal movement of said mandrel with respect to said packer saddle, whereby said bypass seal means carried on said mandrel sealingly engages the interior of said packer saddle.

2. The apparatus of claim 1, wherein said mandrel further includes an upper adapter at the top thereof, and said biasing means comprises a spring disposed about said mandrel between said upper adapter and said upper slip assembly.

3. The apparatus of claim 1, wherein said ratchet teeth on said mandrel and said mating ratchet dog teeth comprise mating right-hand threads.

4. The apparatus of claim 3, wherein said ratchet dogs comprise a plurality of segments circumferentially disposed about said mandrel in said ratchet dog cavity, said ratchet dogs being separated by spacer legs extending upwardly into said cavity from said lower slip wedge collar.

5. The apparatus of claim 1, wherein said lower slips ride on ramps on said lower slip wedge collar and are slidably secured thereto through the interaction of laterally extending webs on the inner surface of said slips extending into lateral channels proximate said ramps in radially extending walls in said lower slip wedge collar disposed between said lower slips, said walls abutting both sides of each of said slips.

6. The apparatus of claim 5, wherein said lower slips include T-shaped struts at the bottom thereof, and said lower slips are secured to said drag block assembly through a lower slip collar having longitudinal strut channels therein adapted to receive said struts, said strut channels including grooves in the sides of said channels for accommodating the laterally oriented ends of said struts.

7. The apparatus of claim 1, wherein said upper slip assembly includes an upper slip collar disposed about said mandrel and biased against a shoulder thereon by said biasing means; upper slips laterally slidably disposed in radially extending slots in said slip collar; and spring means adapted to maintain said upper slips against said mandrel in said slots.

8. The apparatus of claim 1, wherein said drag blocks are biased outwardly in said drag block housing by springs acting against the interior of said drag blocks.

* * * * *